United States Patent [19]

Magill et al.

[11] 4,184,288

[45] Jan. 22, 1980

[54] SMOKE AND FIRE SHIELD DAMPER

[75] Inventors: Robert J. Magill, Whitstable; Sydney J. Field, Ashford, both of England

[73] Assignee: Actionair Equipment Limited, Whitstable, England

[21] Appl. No.: 916,357

[22] Filed: Jun. 16, 1978

[30] Foreign Application Priority Data

Jun. 23, 1977 [GB] United Kingdom ..... 26387/77

[51] Int. Cl.[2] ..... E05F 15/20

[52] U.S. Cl. ..... 49/7; 49/84; 98/110; 98/121 A; 137/601

[58] Field of Search ..... 49/1, 3, 7, 8, 77, 78, 49/91, 92, 31, 84; 98/110, 112, 113, 121 R, 121 A; 137/601

[56] References Cited

U.S. PATENT DOCUMENTS

| | | | |
|---|---|---|---|
| 3,372,514 | 3/1968 | Adams | 49/91 |
| 3,771,559 | 11/1973 | Allen | 98/110 X |
| 3,996,952 | 12/1976 | Root | 49/7 X |
| 4,080,978 | 3/1978 | McCabe | 137/601 X |

FOREIGN PATENT DOCUMENTS

| | | | |
|---|---|---|---|
| 60930 | 8/1954 | France | 49/92 |

*Primary Examiner*—Kenneth Downey

*Attorney, Agent, or Firm*—Berman, Aisenberg & Platt

[57] ABSTRACT

A combination smoke and fire shield damper comprising a line of blades each of which is so supported for rotation in a surrounding frame that the blades are swingable about parallel axes to open or close an opening in the frame, in which the blades are provided with "opened-out" trailing edges so that the leading edge of each blade interlocks with the trailing edge of an adjacent blade when the blades are in their fully-closed positions.

7 Claims, 22 Drawing Figures

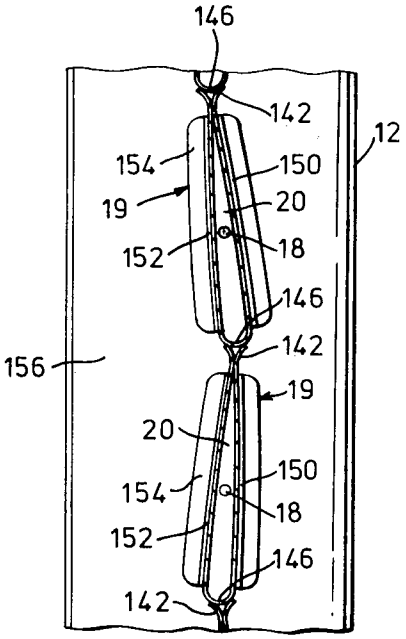
Fig. 22
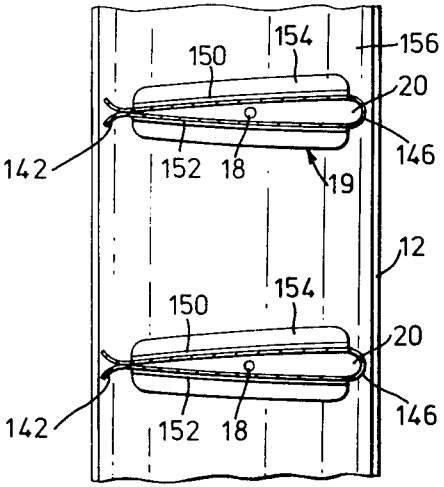
Fig. 21
Fig. 19
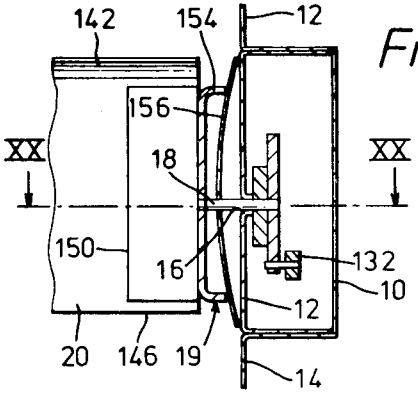
Fig. 20
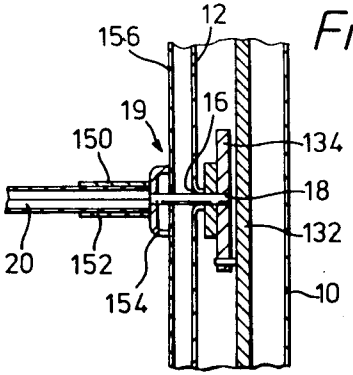

SMOKE AND FIRE SHIELD DAMPER

This invention relates to a combination smoke and fire shield damper, that is to say, a damper which is effective as a barrier against both smoke and fire. More specifically, the invention relates to a smoke and fire shield damper comprising metal blades which move, or are movable, into positions where they block a duct or other passage in which the damper is located, if and when fire breaks out.

Smoke and the other products of combustion from fire account for the largest proportion of deaths in building fires. Smoke and toxic gases will percolate a building through ventilation ductwork if ineffective damper protection is provided and thus put at risk occupants who would not normally be threatened by the direct effects of fire. A building ventilation system, if lacking effective damper equipment, is therefore a perfect vehicle for the rapid and extensive spread of fire. Moreover, a smoke-logged building is difficult and hazardous to evacuate, partly because of the panic that smoke creates, while fire-fighting is made more exacting because the seat of the fire is obscured.

Experience has shown that, if ducting can be efficiently sealed in the event of fire so as to control the insipient spread of smoke-laden hot toxic gases through a building, the life risk can be substantially reduced and the potential high financial loss minimised. Hitherto, however, fire dampers have not been designed or equipped to prevent the leakage of smoke through them once the dampers have been closed. In other words, existing fire dampers fail as smoke dampers.

It is therefore the aim of the present invention to provide a damper with blades of such a construction that the damper is able to act both as a fire damper and as a smoke damper.

The present invention is accordingly directed to a combination smoke and fire shield damper comprising a line of blades each of which is so supported for rotation in a surrounding frame that the blades are swingable about parallel axes to open or close an opening in the frame, in which the blades are provided with "opened-out" trailing edges so that the leading edge of each blade interlocks with the trailing edge of an adjacent blade when the blades are in their fully-closed positions.

Preferably the blades are of aerofoil section and have opened-out trailing edges in the form of V-section fish-tail portions which are thus able to embrace the respective rounded leading edge portions of adjacent blades. The blades will normally be formed by bending a rectangular sheet of metal such as stainless steel to blade shape.

Preferably the blades are movable automatically into their fully-closed positions by spring-loaded actuating means controlled by a fusible link which melts when a fire breaks out. The spring-loaded actuating means can comprise intermeshing gear wheels—one for each blade—which can be rotated in unison by one or more springs. The fusible link will normally be easily releasable from the damper to permit an engineer to test the movement of the blades.

Three examples of combination smoke and fire shield dampers in accordance with the invention are shown in the accompanying drawings, in which:

FIG. 19 is an enlarged section, on a smaller scale however than FIG. 18, through the end portion of one blade in FIG. 17 and the adjacent part of the damper frame;

FIG. 20 is a section taken on the line XX—XX in FIG. 19;

FIG. 21 is a section through two adjacent blades of the damper shown in FIG. 17 in their fully-open positions; and FIG. 22 is a section similar to FIG. 21 through the same two blades in their fully-closed positions.

Figure 1:
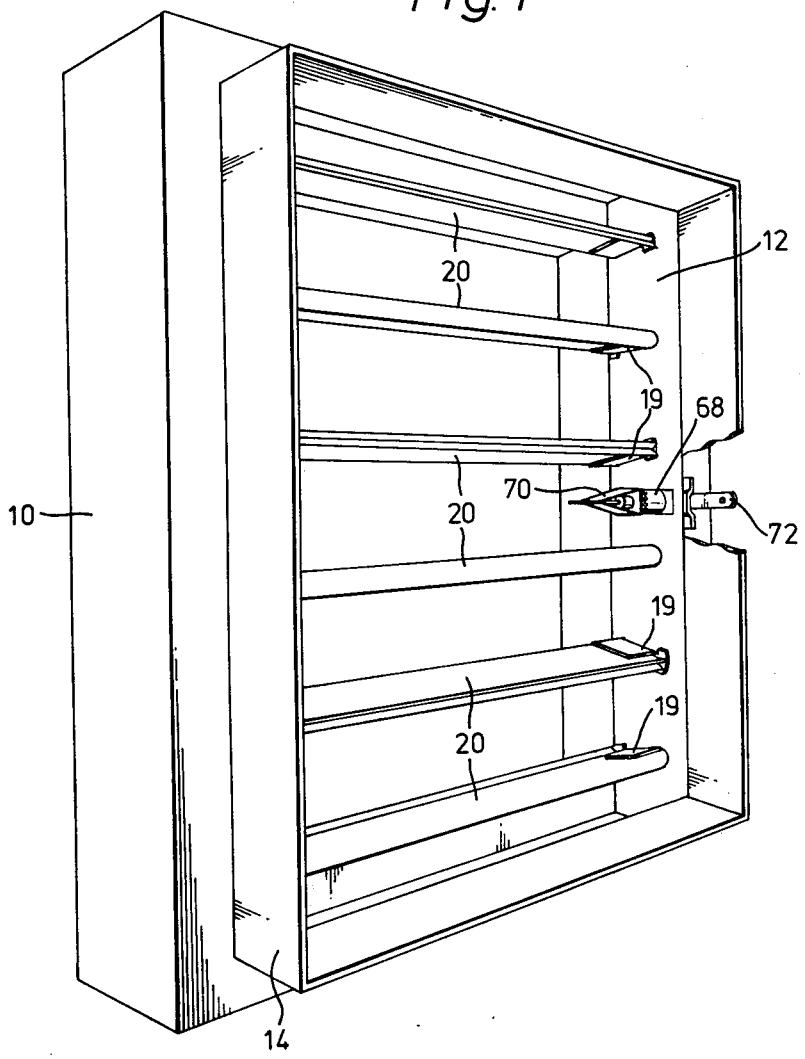
FIG. 1 is a perspective view of one form of damper with a small portion shown in section.
Figure 2:
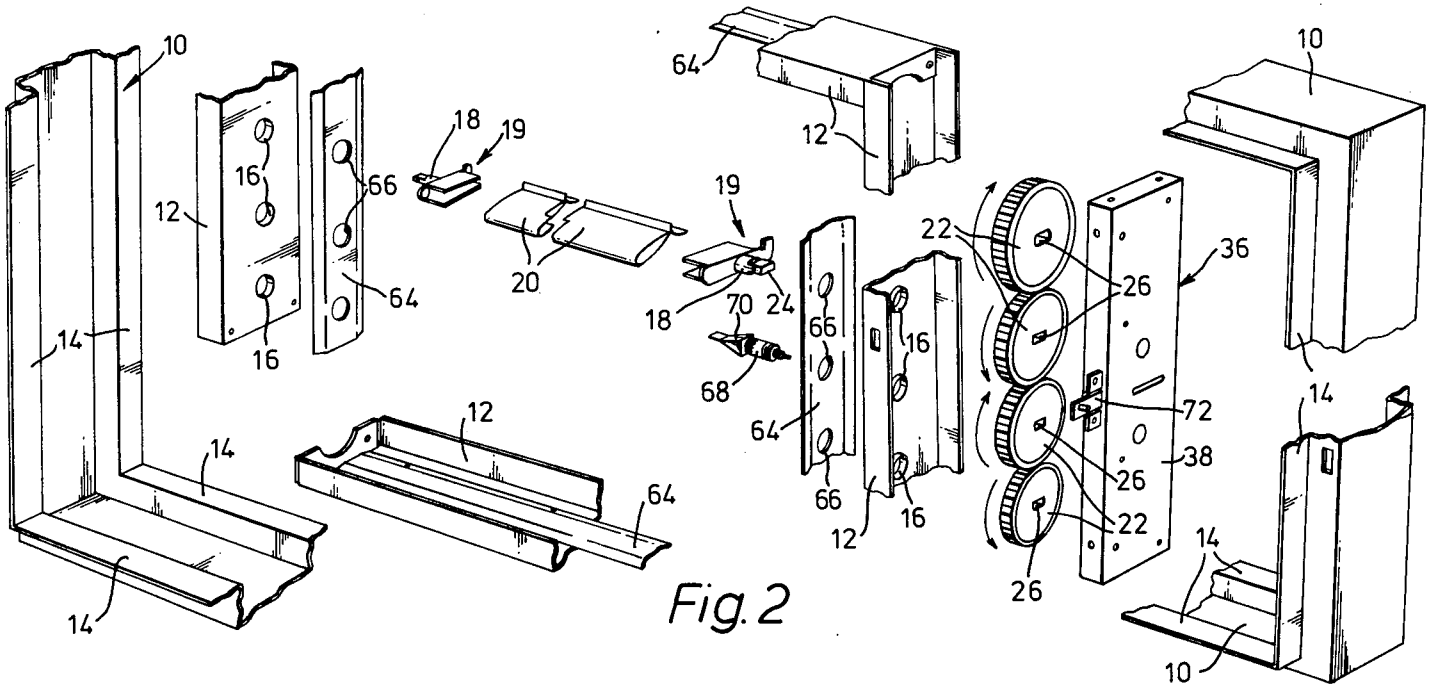
FIG. 2 is an exploded view in perspective of part of the damper shown in FIG. 1.
Figure 12:
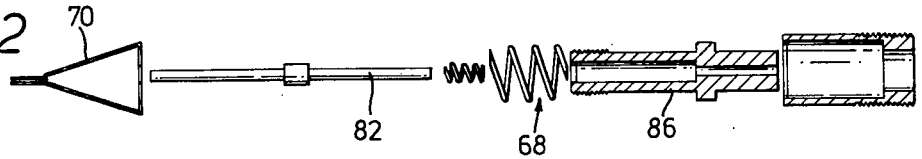
FIG. 12 is an exploded view of the fusible link.
Figure 13:
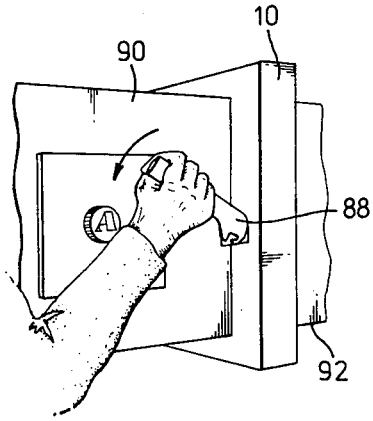
FIGS. 13 and 14 are perspective views of the damper of FIG. 1 installed in an air duct and illustrate the manner in which the fusible link is released from the damper for the purpose of testing the blades.
Figure 14:
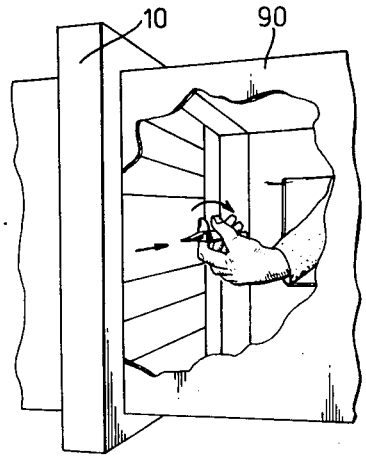

The damper shown in FIGS. 1 and 2 comprises a roll-formed galvanised sheet steel outer frame 10 of flanged channel section and a sheet steel channel-section inner frame 12. The outer frame 10 has continuously-welded corners and has outwardly-extending flanges 14 adapted to enter the ends of two air ducts arranged end-to-end but with a gap between them to receive the damper as shown in FIGS. 13 and 14. The attachment by welding, bolting, rivetting, or other means of the inner and outer frames together produces a double-skin air-tight casing of high rigidity and substantial strength.

As will be seen from FIG. 2, the inner frame 12 has a series of circular holes 16 which are so punched in its two vertical sides that the holes 16 have a length greater than the actual thickness of the metal. The holes 16 support the shafts 18 of blade bearing components 16 which fit into and onto the open ends of blades 20 which are thus mounted for rotation in the frame about parallel axes. The blades 20 are low-profile aspect ratio aerofoil stainless steel blades to provide low resistance to air or other gaseous fluid flowing through the damper, especially when the blades are in their fully-open positions (i.e. the positions of the blades shown in FIG. 1 of the drawings). The aerofoil section of the blades also reduces turbulence and noise and provides excellent protection against corrosion resulting from the presence of corrosive particles in the air stream. Another advantage is that the narrow blade width readily permits the withdrawal of the complete damper from a duct, regardless of the positions of the blades within the damper casing, without materially disturbing the flow of air through the duct frame as a whole.

Rotation of the blades about their respective axes is effected through gear wheels 22, there being a respective gear wheel 22 for each blade 20. As will be seen from FIG. 2, the shaft 18 of each blade bearing component 19 has a keyed end 24. The shafts 18 on one side of the damper having their keyed ends 24 arranged to enter rectangular-section central holes 26 in the gear wheels 22 which are arranged in meshing engagement and disposed in a line vertically of the damper. It thus follows that the gear wheels 22 will always rotate in unison so that all the blades 20 will move together about their respective axes. However, as shown by the arrows in FIG. 2, alternate gear wheels 22 will rotate in opposite senses so that adjacent pairs of blades 20 will likewise rotate in opposite senses or directions to open or close the central passage through the damper.

The gear wheels 22 are acted on, directly or indirectly, by one or more springs or other resilient means so as to urge the blades 20 towards their closed positions. This can be done in various ways, using various forms of spring. In this particular instance, two of the gear wheels 22 are rotatably fast with two spring-loaded wheels or discs 28 (see FIG. 3), each of the wheels or discs 28 being acted on by a coiled spring 30 which is connected at one end to the periphery of its respective disc 28 by a pin 32 and is supported on a pin 34 in a control box 36 having a removable cover 38. The two discs 28 have stub-shafts 40 projecting from each side, and these enter circular holes 42 in the side 44 of the control box 36 and circular holes 46 in the control box cover 38. The positions of the discs 28 and the coiled springs 30 in the control box 36 are shown in broken lines in FIG. 3.

Figure 3:
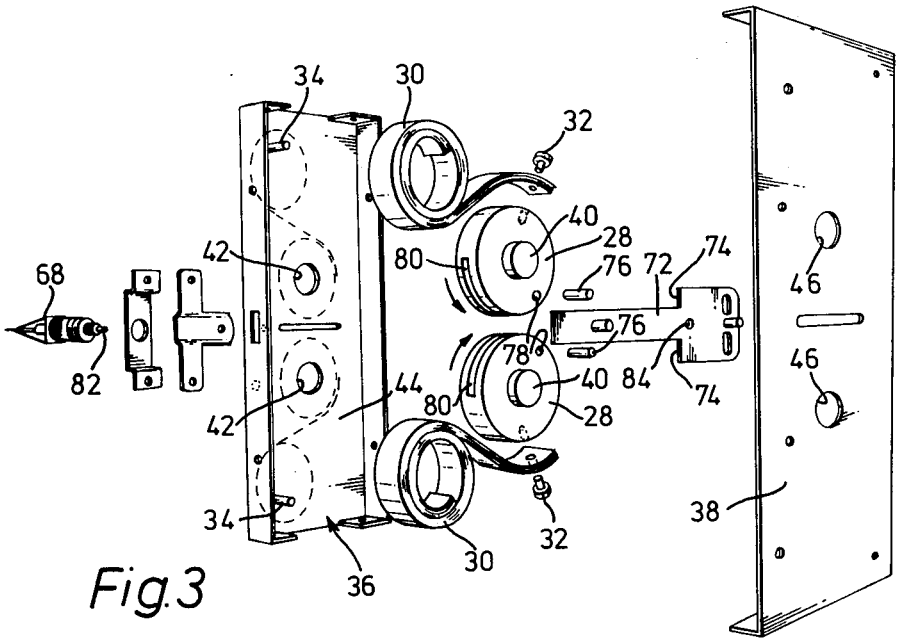
FIG. 3 is an exploded view in perspective of a further part of the damper shown in FIG. 1.

The effect of the springs 30 on the discs 28 is to urge the latter to rotate in opposite senses or directions as shown by the arrows in FIG. 3. Because the two discs are rotationally fast with two adjacent gear wheels 22 (by, for example, coupling the stub shafts 40 passing through the holes 42 to the shafts 18 which enter those gear wheels, or by connecting the ends of those stub shafts 40 direct to the respective gear wheels 22), all the gear wheels 22 will be urged to rotate in such directions that the blades 20 are urged into their fully-closed positions so as to completely close the central passage formed by the frames 10 and 12 of the damper.

It is to be understood that many other forms of spring-loading could be used to obtain the desired effect—namely, to urge the blades resiliently into their fully-closed positions. For example, one or more of the gear wheels 22 could be provided with a torsion spring, or a tension spring could be attached to a peripheral portion of one or more of the gear wheels.

Because the damper has to serve both as a smoke damper and as a fire shield damper, the gear wheels 22, the discs 28 and the blade bearing components 19 are preferably all made of metal, but it may be acceptable in certain instances for these particular parts to be made of a synthetic plastics material instead. Whatever the material used, such gear wheels, discs and bearings can be precision-moulded and are then totally enclosed and completely shut off from the air stream through the damper by the outer and inner frames 10, 12 and by the control box 36. This ensures that the said gear wheels, discs and bearings do not become dirty or contaminated with impurities in the air stream.

Figure 4:
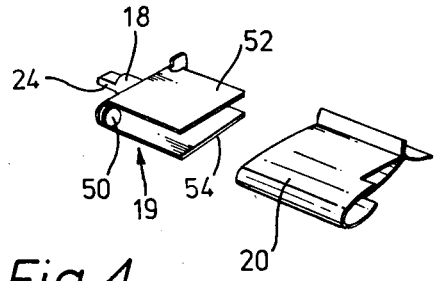
FIG. 4 is an enlarged view of part of FIG. 2 to illustrate a bearing component for supporting an end of a blade.
Figure 5:
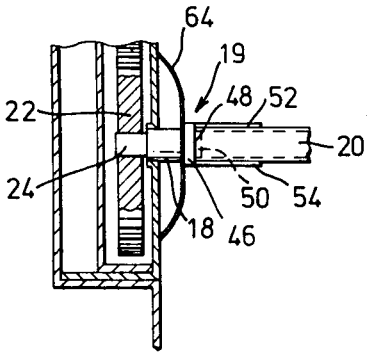
FIG. 5 is a side view of the bearing component shown in FIG. 4 as mounted in the damper.

FIGS. 4 and 5 illustrate in a little more detail then FIG. 2 the blade bearing components 19 which support the ends of the blades 20. As already described above, the shaft 18 of each component 19 has a keyed end 24 which enters the hole 26 in its respective gear wheel 22. The other end of the shaft 18 of each component 19 terminates at an intermediate flange 46 on the component which forms a surface 48 opposing the adjacent end of its respective blade 20. Projecting from that surface 48 of the flange 46 is a spigot 50 which enters the adjacent open end of the blade 20. A pair of ridges 52 and 54 are also formed on the flange 46 of the blade bearing component to receive the extreme end-portion of the blade between them. These ridges give additional support to the blade end and cooperate with the spigot 50 to support that end of the blade for rotation of the blade about an axis parallel to its leading and trailing edges.

Figure 6:
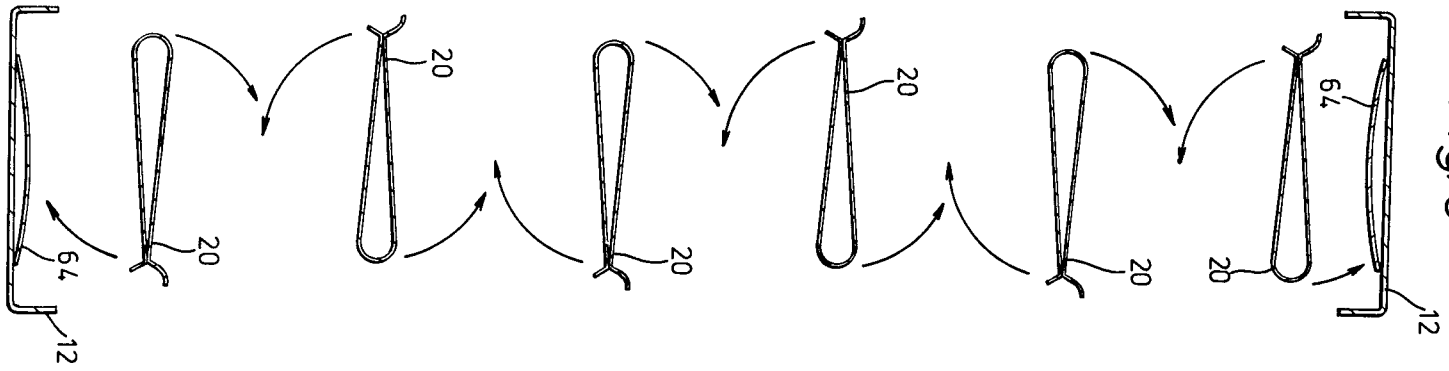
FIG. 6 is a diagrammatic sectional view showing the blades in their fully-open positions.
Figure 7:
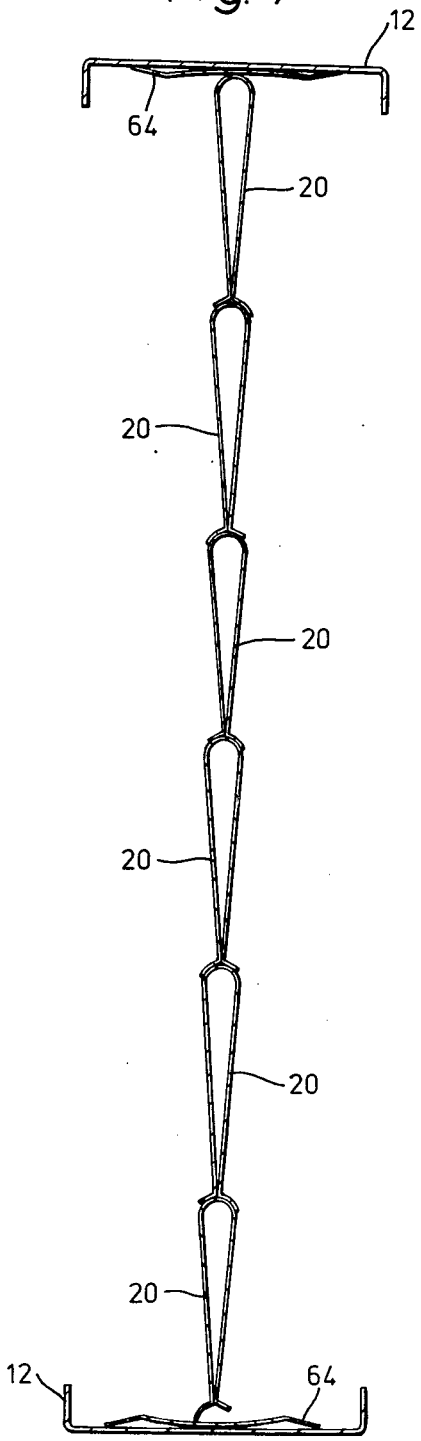
FIG. 7 is a view similar to FIG. 6 showing the blades in their closed positions.

The extent to which the blades can be rotated about their respective axes can be varied to suit the requirements of different customers. Normally they will be rotatable through 90° to provide for maximum flexibility in use. This is illustrated by FIGS. 6 and 7 of the drawings which show the blades in their fully-open and fully-closed positions respectively. In their fully-closed positions, it is essential that the blades be able to act both as a smoke shield and as a fire shield. Accordingly, the blades are so constructed that the leading edge of each blade interlocks with and makes a good seal with the trailing edge of an adjacent blade when the blades are in their fully-closed positions. For this purpose, the trailing edge of each blade has the special "fish-tail" shape illustrated in FIG. 8 of the drawings. Thus, after the blade has been bent into blade-shape from a flat rectangular sheet of stainless steel, it is sealed by being welded, brazed, rivetted or otherwise connected along a zone 56 adjacent its trailing edge. At the same time, its trailing edge portions 58 and 60 are "opened-out" to form a V-section fish-tail portion which is thus adapted to embrace the respective rounded, preferably arcuate, leading edge portion 62 of an adjacent blade when the blades are in their closed positions. It will be noted that, whereas the "turned-out" trailing edge portion 60 is entirely straight, the trailing edge portion 58 is straight for part of its total area and is then curved arcuately over the remaining part for an angular distance of 60°. This permits the trailing edge portion 58 to conform closely to the arcuate leading edge portion 62 of the adjacent blade when the blades are in their closed positions. It also ensures that the blades are firmly interlocked together and provide an excellent seal against the passage of both fire and smoke through the damper.

Figure 8:
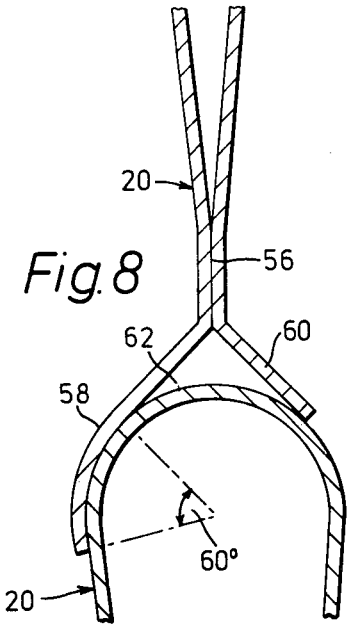
FIG. 8 is an enlarged sectional view through the interlocking trailing and leading edges of two adjacent blades in the damper.

If desired, a sealing strip (not shown) can be bonded within the V of the fish-tail portion, the strip being compressed by the leading edge portion 58 of the adjacent blade when the blades are in their fully-closed positions shown in FIGS. 7 and 8. By this means, leakage of smoke at the leading and trailing edges of the blades can be reduced, in practice, to a negligible amount. It is not essential, however, for such a sealing strip to be provided.

To seal the leading edge of the uppermost blade, the trailing edge of the lowermost blade and the ends of all the blades, springy metal sealing strips 64 are arranged along the inner surfaces of the inner frame 12 as shown in FIG. 2. Each sealing strip 64 is here made of springy steel and is of arched section. The two horizontal strips 64 at the top and bottom of the damper lie in the channels of the inner frame, while the two vertical strips 64 at the sides of the damper lie between the flanges 46 of the blade bearing components 19 and the opposing surfaces of the inner frame. For this purpose, the vertical strips 64 have holes 66 formed in them to allow for the passage therethrough of the shafts 18. The arched form of the strips 64 not only helps to reduce the leakage of fumes and smoke through the damper when the blades are in their fully-closed positions but allows the strips to yield as the blades expand due to the heat of a fire.

As will be appreciated, the blades 20 must be held in their fully-open positions to allow for the passage of air through the damper during normal use of the air duct or ducts in which the damper is installed. This means that a device needs to be provided which will hold the blades open against the action of the springs 30 but which will allow those springs to shut the blades, i.e. bring them into their fully-closed positions, should fire break out. The best form of device is therefore one which is sensitive to a rise in temperature, and the damper shown in FIGS. 1-8 is accordingly provided with a temperature-sensitive all-stainless steel spring-operated removable cartridge 68 carrying a replaceable fusible element 70 rated, say, at 72° C. (162° F.), the element 70 having a very low thermal capacity so as to be extremely sensitive to temperature rise. FIGS. 9–12 show the construction of the cartridge 68 which is easily removable from the inner casing 12, without the use of tools, by simply unscrewing it from the latter. The fusible element 70, which lies prominently in the air-stream (see FIG. 1), is likewise readily replaced in the event of fire or damage by unscrewing the captive end of the cartridge. As will be explained below, fusing of the element 70 or removal of the fusible element or the cartridge as a whole provides the fail-safe feature of instant blade closure.

The control box 36 shown in FIG. 3, besides housing the discs 28 and the springs 30, also supports and partially contains a sliding operating member 72 which acts on the spring-loaded discs 28 so as to rotate them into a position where the blades 20 are held in their fully-open positions. It should be mentioned, incidentally, that the torque available from either spring 30 is more than sufficient to close all the damper blades, thus providing a fail-safe feature in the unlikely event of failure of one of the two springs. Thus, linear movement of the operating member 72 to its completely extended position shown in FIG. 2, either by hand or by a motor (not shown), causes two shoulders 74 on the member 72 to engage two pins 76 on the discs 28, the pins 76 being located in holes 78 and acuate peripheral grooves 80 in the discs. This causes the discs to rotate and to open the damper blades against the spring tension, the blades then being held fully open through the automatic engagement of the spring-loaded actuating pin 82 of the cartridge 68 in a hole 84 in the operating member 72.

Figure 9:
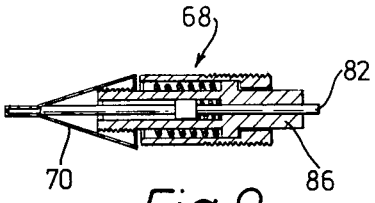
FIGS. 9, 10 and 11 are enclosed sectional views through a fusible link forming part of the damper shown in FIG. 1.

The parts of the cartridge 68 will now be in their positions shown in FIG. 9. Should the fusible element 70 subsequently melt, the parts of the cartridge will take up the positions shown in FIG. 11, with the pin 82 withdrawn from the hole 84 in the operating member 72. The discs 28 will therefore no longer be held in the "blades open" position, so that the springs 30 will rotate the discs into the "blades closed" position. The operating lever 72 will simultaneously be shifted back to its inoperative position.

Figure 10:
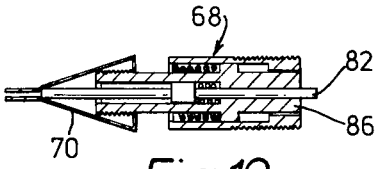
Figure 11:
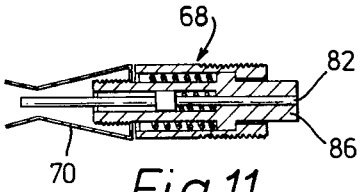

Closure of the blades other than by removal of the cartridge or fusible element or by fire melting the fusible element is simply accomplished by depressing a spring-loaded plunger 86 in the cartridge, either by using a hand-tool 88 as shown in FIGS. 13 and 14 or remotely through a solenoid (not shown), to withdraw the actuating pin 82 from the hole 84 in the operating member 72 and allowing the latter to return to its retracted or inoperative position. This is illustrated in FIG. 10 of the drawings. It is to be noted that the position of the operating member 72 provides a visual indication of the damper blades position.

The fact that it is possible to over-ride the fusible cartridge from outside a duct makes for simplicity and considerable time-saving in the testing and resetting of the damper in accordance with the British Standard Code of Practice, Revision of CP 413 Ducts for Building Services, and corresponding codes of practice in the United States of America, Canada and other countries.

Figure 15:
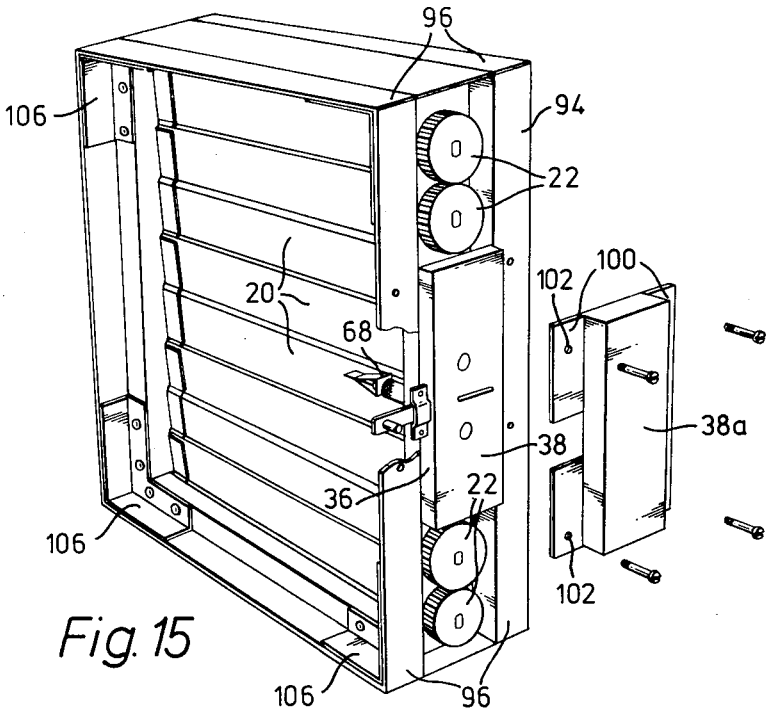
FIG. 15 is a view similar to FIG. 1 of a second form of damper.
Figure 16:
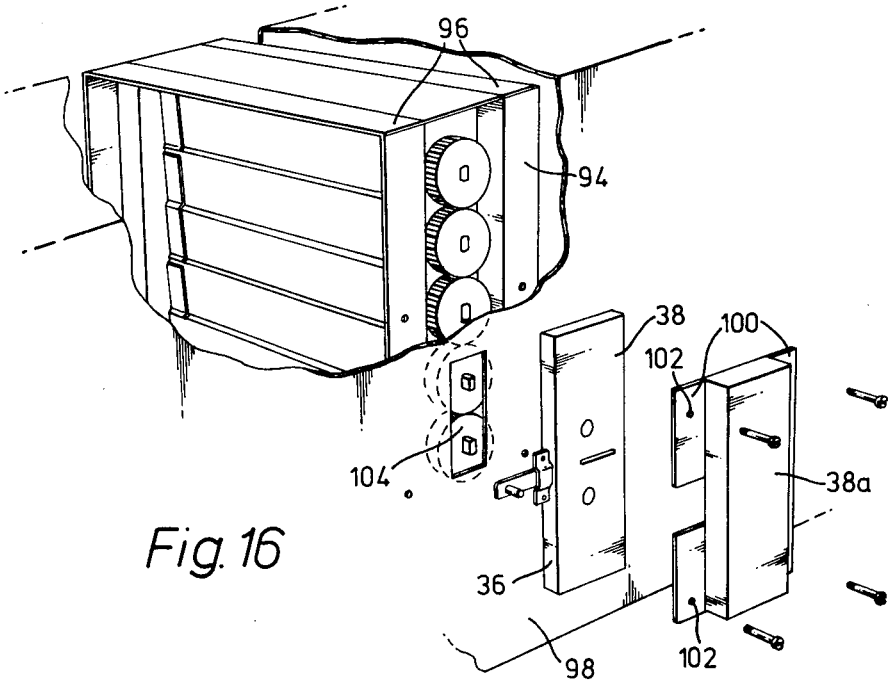
FIG. 16 is a reduced-size perspective view of the damper of FIG. 15 installed in a duct.

As already indicated, the damper illustrated in FIGS. 1–12 is designed to be inserted in a duct by arranging for the flanges 14 of the outer casing 10 to be inserted in the opposing ends of two duct portions 90 and 92 as shown in FIGS. 13 and 14. In other words, the damper is inserted in a "break" in a duct so that the inner frame 12 is substantially flush with the internal surfaces of the duct. However, in certain countries—particularly the United States of America—it is customary to position dampers entirely within a duct. FIGS. 15 and 16 illustrate a damper having a frame 94 which permits this to be done. The frame 94 is, in effect, the same as the inner frame 12 in FIG. 2 except that the frame 94 has flanges 96 which lie against the inner surface of a duct as shown in FIG. 16. The duct itself therefore forms an outer frame for the damper so that the outer frame 10 of FIGS. 1 and 2 is no longer needed.

The remaining parts of the damper shown in FIGS. 15 and 16 are essentially the same as that shown in FIGS. 1–14, except that an additional cover plate **38*a* in FIG. 15 is designed to be screwed or bolted to the outside of a duct 98. The cover plate 38*a* therefore has a pair of flanges 100 with bolt or screw holes 102 in it to permit this to be done. A small window 104 is cut in the wall of the duct 98 to allow the shafts 40 of the discs 28 to project through that wall and thus enter the control box 36. Screw or bolt holes (not shown) will naturally be provided in the duct wall to match the holes 102 in the flanges 100**.

In order to strengthen the inner frame 12 of FIG. 2 and the frame 94 of FIGS. 15 and 16, L-shaped metal corner pieces 106 are welded, rivetted or otherwise fixed to the corners of those frames.

FIGS. 17–22 show a third form of damper in accordance with the invention. It has certain differences from the two dampers already described so that a full description of it is given below.

Figure 17:
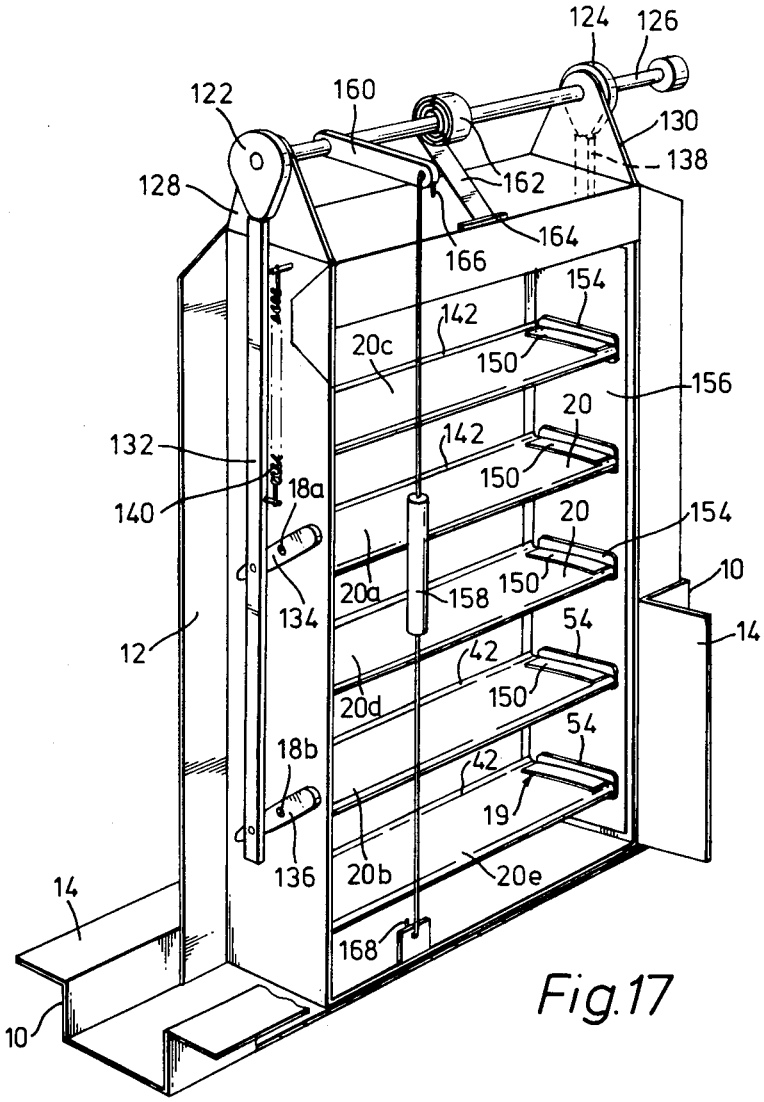
FIG. 17 is a view similar to FIGS. 1 and 15 of a third form of damper.

The damper shown in FIG. 17 comprises a hollow, rectangular roll-formed galvanised sheet steel outer frame 10 of girder section with outwardly-projecting side flanges 14, and a hollow, rectangular, sheet steel inner frame 12 of channel-section. The inner frame 12 has a series of holes punched in its two vertical sides, and one of these holes is shown at 16 in FIGS. 19 and 20. The punching operation by which these holes are produced is such that the holes have a length greater than the actual thickness of the metal. The said holes 16 serve to support shafts 18 on blade-bearing components 19 to which the respective end portions of damper blades 20 are connected so that the blades are mounted for rotation in the frame 12 about parallel axes.

The blades 20 are of stream-lined shape so as to provide low resistance to air or other gaseous fluid flowing through the damper, especially when the blades are in their fully-open positions (i.e., the positions of the blades shown in FIGS. 17 and 21 of the drawings). Thus, as in the dampers shown in FIGS. 1–16, the blades here are of generally aerofoil section.

Rotation of the blades 20 about their respective axes is effected by a pair of cams 122 and 124 mounted on a cam-shaft 126 at the top of the frame 12, the cam-shaft being rotatably supported by a pair of brackets 128 and 130 or any other suitable supporting means. The cam 122 is arranged to actuate a longitudinally-displaceable link-rod 132 to which are pivotally connected two crank-arms or levers 134 and 136 mounted fast on the support shafts 18*a* and 18*b* of the two blades 20*a* and 20*b*, the link-rod 132 being located in one vertical channel of the inner frame 12. Similarly, the other cam 124 is arranged to actuate a longitudinally-displaceable link-rod 138 in the other vertical channel of the frame 12, the link-rod 138 having crank-arms or levers (not shown) like the ones 134 and 136 pivotally connected to it in respect of the shafts 18 on the three other blades 20*c*, 20*d* and 20*e*.

It will therefore be seen that rotation of the cam-shaft 126 causes the cams 122 and 124 to displace their respective link-rods 132 and 138, and thus rotate the blades 20 out of their fully-open positions shown in FIG. 17 into their fully-closed positions shown in FIG. 22. For a reason which will be explained later, the two blades 20*a* and 20*b* move ahead of the other blades 20*c*,20*d* and 20*e*.

In order to keep each link-rod 132, 138 in contact with its respective cam 122, 124, a light spring 140 is arranged to act on each link-rod. As the damper may well have to endure very high temperatures, the cams 122, 124, the link-rods 132,138 and the crank-arms or levers 134,136 will normally be made of pressed steel or other high-melting point metal or alloy. These components are totally enclosed in the damper casing and are thus completely shut off from the air stream through the damper. This ensures that they do not become dirty or contaminated with impurities in the air stream.

Figure 18:
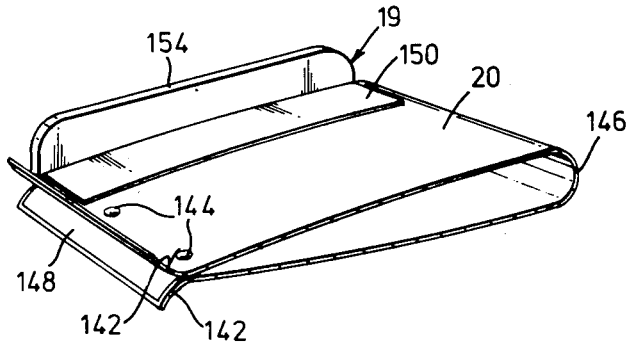
FIG 18 is an enlarged perspective view of an end portion of one of the damper blades in FIG. 17 and a bearing component supporting that blade end portion.

From FIG. 18 it will be seen that the trailing edge of each blade 20 is formed with an outwardly-flared "fish-tail" portion 142 by bending outwardly the two mating longitudinal edge sections of a single sheet of stainless steel which is used to produce each blade. The said edge sections are spot-welded or otherwise attached to each other as shown at 144 immediately in front of the fish-tail portion. As shown in FIG. 22, the V-section fish-tail portion 142 of the blade serves to embrace the rounded leading edge portion 146 of an adjacent blade when the blades are in their fully-closed positions, i.e. when they are substantially in alignment with one another.

A layer or strip 148 of pliable or compressible sealing material (see FIG. 18) is applied to the inner surface of the fish-tail portion 142 of each blade 20 to improve the seal made with the leading edge 146 of an adjacent blade when the blades are in their fully-closed positions. The said sealing material need not be one able to withstand high temperatures as the heat of any fire will soon cause such expansion of the blades 20 as to close any gaps between them. In other words, the layer or strip 148 serves to provide an improved seal until such time as heat has caused the blades to expand.

It will be seen from the drawings that each portion of each blade 20 is embraced by, or is sandwiched between, a pair of shrouds 150 and 152 forming part of the blade-bearing components 19. These shrouds project inwardly from a hollow trough-like metal sealing member 154 mounted on or otherwise fixed to each shaft 18. It is important that, should fire break out, there should be a minimum of leakage of fumes and smoke through the damper. Accordingly, the metal sealing members 154 are arranged to make sealing contact with a pair of springy sealing strips 156 (of which only one is visible in the drawings) which lie alongside the two vertical sides of the frame 12. Each sealing strip is here made of springy steel and is of arcuate section (see FIG. 19) with the convex face in contact with the edges of the sealing members 154. The arcuate section of the springy-steel side sealing strips 156 not only helps to reduce the leakage of fumes and smoke through the damper in the event of fire but allows the strips to yield as the blades 20 expand due to the heat of the fire.

It is naturally desirable, if not essential, that the blades 20 should move automatically to their closed positions on the outbreak of fire. As in most fire dampers, this can be effected by providing a fusible link 158 as shown in FIG. 17 of the drawings, the link being attached at one end to an arm 160 on the cam-shaft 126 and at the other end to the lower part of the frame 12. In addition, a torsion spring 162 surrounds the cam-shaft 126 and is anchored at 164 on an upper part of the frame 12. This means that, if a fire breaks out, the fusible strip 158 will melt and will then allow the torsion spring 162 to rotate the cam-shaft 126 and the cams 122 and 124 with the result that the blades 20 are moved immediately into their fully-closed positions. The fusible strip 158 is provided with hooks 166 and 168 on at least one of its ends so that it can be unhooked by a test engineer to ascertain whether the torsion spring 162 is in a good condition to close the blades 20.

It will be noticed from FIG. 22 that, in their fully-closed positions, the blades 20 interlock with each other at their leading and trailing edges. To permit such interlocking, the cam 122 is arranged to rotate the two blades 20*a* and 20*b* through an angle of just over 90° (i.e. about 100°) so that the said two blades reach their end positions before the other blades 20*c*,20*d* and 20*e*. This allows the leading edges 146 of the blades to enter the fish-tail trailing edges of adjacent blades and then lock the blades into the fully-closed position of FIG. 22.

The specific fire damper shown in the drawings has five blades 20, but it is to be understood that any other suitable number of blades can be used instead.

It will therefore be seen that all three dampers described above have stainless steel aerofoil blades of welded double-skin construction to reduce heat transfer, the blades interlocking within fish-tail trailing edges to provide a continuous double metal seal which forms a fire-resisting shield in combination with high impedance to the leakage of smoke and other products of combustion. Likewise, the blade-bearing components 19 of stainless steel which embrace the ends of the aerofoil blades cooperate with stainless steel springy strips arranged to perform the dual function of maintaining a corrosion-resistant compression seal to prevent cold smoke leakage whilst leaving the blades freedom for expansion under full fire conditions within a duct.

The finely-toothed precision-moulded gear wheels 22 afford high strength, low weight, and positive movement with instant blade closure action, regardless of whether the damper is arranged vertically or horizontally, through the stainless steel constant-tension coiled springs 30. The gear wheels are totally enclosed so as to be completely out of the airstream and can be made of a die-cast zinc alloy or a synthetic plastics material which softens at approximately 400° C. to eliminate the risk of thermal movement in the full fire condition, thus ensuring no interference with the fully-interlocked closed positions of the blades.

Various modifications may be made to the dampers described above and shown in the drawings. For example, instead of the blades being spring-loaded towards their fully-closed positions, they could be spring-loaded towards their fully-open positions where such a requirement is necessary. This would apply where dampers in accordance with the invention are installed in the wall of a central tube extending upwards through a building like a chimney for the purpose of drawing smoke out of the building and into the atmosphere should fire break out within the building. As will be appreciated, the dampers in the wall of the tube would normally have their blades in their fully-closed positions, but in the event of fire the fusible links of the dampers would melt and the blades would then be urged by their respective spring means into their fully-open positions so as to allow smoke from the fire to pass into the central tube.

In the above description it has been assumed that the frame will contain just one set of blades. It is however equally possible for there to be two or more sets of blades arranged within a single frame, thus forming a multiple arrangement where two or more ducts lie parallel and close to one another or where a duct is longitudinally divided by one or more internal partition walls so as to form a plurality of passages, separate from one another, within the same duct. Further, although the flanges 14 of the dampers shown in the accompanying drawings are all adapted for insertion in ducts of square section, those flanges could just as well be shaped for insertion in circular ducts or ducts of eliptical cross-section.

Reference has already been made in the above description to the possibility of using remote control electrical accessories to operate the means controlling the position of the blades in order to facilitate inspection of the damper and to bring about closure or opening of the blades from a remote location in the event of fire. These external electrical accessories can be in the form of electro-magnets, electric motors or solenoids.

We claim:

1. A combination smoke and fire shield damper comprising a frame providing an opening through which air may pass, a line of substantially parallel blades arranged in said opening of the frame, blade supporting means on the frame to support each blade in a rotatable manner so that the blades are swingable about parallel axes to open and close said opening in the frame, said blades being of aerofoil section and thereby having leading edges and trailing edges, said trailing edges being of forked section whereby the trailing edge of a blade embraces and interlocks with the leading edge of an adjacent blade when the blades are in their fully-closed positions to close said opening in the frame, spring-loaded actuating means to move the blades automatically into a selected one of their fully-closed and fully-open positions, a fusible link to initiate operation of said spring-loaded actuating means, the fusible link being designed to melt when a fire breaks out, said spring-loaded blade-actuating means including rotary elements, one for each blade, which are rotatable in unison to cause corresponding swinging movement of the blades between their fully-open and fully-closed positions, said spring-loaded blade actuating means further including a pair of rotatable discs which are rotationally fast with two of said rotary elements so that rotation of those discs causes the said two rotary elements to rotate and drive the other rotary elements.

2. A combination smoke and fire shield damper comprising: a hollow metal frame defining an opening for the passage of fluid therethrough, a line of hollow, sheet-steel, aerofoil-section, open-ended blades arranged in said opening of said frame with each blade having a leading edge and trailing edge, a plurality of blade bearing components, one at each end of each blade, to support the blades on said frame for rotation about parallel axes extending longitudinally of the blades, said blades being swingable about said axes to open and close the said opening in the frame, a shaft on each blade bearing component and a respective aperture in said frame to rotatably receive said shaft, an intermediate flange on each blade bearing component, a surface on said flange opposing the adjacent open end of the respective blade, a pair of spaced-apart ridges projecting from said flange surface of said blade bearing component to receive the extreme end-portion of the blade between them, a plurality of rotary elements, one for each blade, keyed onto the blade bearing components at one side of said frame for the purpose of effecting swinging movement of the blades about their parallel axes, the said rotary elements being rotatable in unison to cause corresponding swinging movement of the blades between their fully-open and fully-closed positions, said blades being provided with rounded leading edges and opened-out fish-tail trailing edges to permit the leading edge of each blade to interlock with, and make a good seal with, the trailing edge of an adjacent blade when the blades are in their fully-closed positions, each blade being bent into blade-shape from a flat rectangular sheet of steel with said opened-out fish-tail trailing edge thereof comprising a first portion which is straight and a second portion, longer that said first portion, which is straight for part of its total area and is then curved arcuately over the remaining part of its area to permit said second portion to conform closely to the rounded leading edge portion of the adjacent blade when the blades are in their fully-closed positions.

3. A damper according to claim 2, wherein spring-loaded actuating means are provided to move the blades, and a fusible link is arranged to initiate operation of said actuating means, said fusible link being easily releasable from the damper to permit testing of the movement of the blades.

4. A damper according to claim 3, wherein the fusible link includes a part which is adapted to engage and hold, in a releasable manner, a movable operating member.

5. A damper according to claim 2, wherein springy metal sealing strips are provided along the sides of the frame to seal the ends of the blades.

6. A damper according to claim 2, wherein springy metal sealing strips are provided at the top and bottom of the frame to seal the longitudinal edges of the uppermost and lowermost blades in the damper.

7. A damper according to claim 2, wherein the frame has flanges adapted to lie against the inner surface of a duct into which the damper has been inserted.

* * * * *